United States Patent [19]

Kroll

[11] Patent Number: 4,570,139

[45] Date of Patent: Feb. 11, 1986

[54] THIN-FILM MAGNETICALLY OPERATED MICROMECHANICAL ELECTRIC SWITCHING DEVICE

[75] Inventor: John W. Kroll, Greendale, Wis.

[73] Assignee: Eaton Corporation, Cleveland, Ohio

[21] Appl. No.: 682,043

[22] Filed: Dec. 14, 1984

[51] Int. Cl.[4] ..... H01H 3/00; H01H 51/08

[52] U.S. Cl. ..... 335/187; 335/128; 335/185

[58] Field of Search ..... 335/187, 186, 185, 199, 335/128, 151, 154

[56] References Cited

PUBLICATIONS

"Micromechanical Membrane Switches on Silicon", Jul., 1979, IBM J. Res. Develop., vol. 23, No. 4, pp. 376–385, Kurt E. Petersen.

"Silicon as a Mechanical Material", May, 1982, Proceedings of the IEEE, vol. 70, No. 5, pp. 420–457, (see particularly pp. 450–452).

*Primary Examiner*—Harold Broome

*Attorney, Agent, or Firm*—C. H. Grace; L. G. Vande Zande

[57] ABSTRACT

A silicon substrate (2,22) having a $SiO_2$ layer (4,24) grown on its upper surface and a metallization layer (6,26) of magnetic material subsequently deposited on the upper surface of the $SiO_2$ layer is etched to define a cantilever beam (8,38) extending over a recess (12,32) in the substrate (2,22) having a magnetic layer (6,26) along the top surface thereof. The resulting structure is subsequently masked with a photoresist layer to enable a second layer (14,34) of magnetic material to be deposited on the first layer. The photoresist layer is stripped forming a second magnetic layer (14,34) projecting from the unsupported end of the cantilever beam over and spaced from a fixed stop (10,30) of magnetic material adjacent the unsupported end of the cantilever beam. In one version the magnetic material (6,14) serves as electrical current carrying contacts which close upon application of a magnetic field to the switching device. Alternatively, an additional layer (36) of better quality electrical conducting material may be bonded to the second magnetic layer (34) as a bridging contact (38) oriented at right angles to the major dimension of the cantilever beam (38) and a pair of contact surfaces (40,42) are bonded to the insulating layer (24) along lateral edges of the substrate (22).

9 Claims, 5 Drawing Figures

THIN-FILM MAGNETICALLY OPERATED MICROMECHANICAL ELECTRIC SWITCHING DEVICE

BACKGROUND OF THE INVENTION

This invention relates to micromechanical switching devices formed by semiconductor batch fabrication techniques. More specifically, this invention relates to switches of the aforementioned type wherein the device is formed to have a cantilever beam extending over a shallow recess for deflection into and out of engagement with a fixed member at a side of the recess opposite that at which the cantilever beam is supported.

Switches of the aforementioned type are known (see for example articles by Kurt E. Petersen: "Micromechanical Membrane Switches on Silicon", July, 1979, IBM J. Res. Develop., Vol. 23, No. 4, pp. 376–385 and "Silicon as a Mechanical Material", May, 1982, Proceedings of the IEEE, Vol. 70, No. 5, pp. 420–457.) Such switches may be of the single-contact low-current type wherein the cantilever beam serves as a current carrying movable contact member engageable with a fixed contact or may be of a double-contact configuration for carrying higher currents. In the latter instance a bridging contact bar is fixed to the cantilever beam to project in opposite directions normal to the major dimension of the cantilever beam for bridging a pair of fixed contacts. The aforereferenced articles describe in detail the various steps of layer growth and formation, metallization, photoresist applications and etching to arrive at the desired structure through semiconductor fabrication techniques. In the aforementioned switches, the recess over which the cantilever beam is suspended has a $p^+$ silicon at the bottom surface of the recess. A voltage applied between the $p^+$ layer and the metallization at the upper surface of the cantilever beam establishes a capacitive effect which applies an electrostatic force on the cantilever beam, pulling it downward until the unsupported end of the cantilever beam makes contact with a fixed stop or electrical contact. While these switches are suitable for their intended purposes, the electrostatic forces utilized therein do not provide adequate contact forces to permit the use of such switches for typical mechanical switching applications.

SUMMARY OF THE INVENTION

This invention provides a thin-film micromechanical electric switch of the general type described above but which is magnetically operable as opposed to electrostatically operable. The switch is constructed by semiconductor fabrication techniques wherein a silicon substrate is suitably fabricated to provide an insulating layer along an upper surface thereof which layer includes a cantilevered beam extending over a recess in the silicon substrate. The upper insulating surface is provided with a metallization layer of magnetic material. A second layer of magnetic material is deposited to the unsupported end of the cantilevered beam to project over a fixed portion of the first magnetic layer in spaced relation thereto. The magnetic layer along the cantilever beam, second projecting layer of magnetic material, and fixed stop of magnetic material may serve as current carrying contact members for a single-contact switch, or a bridging contact bar may be fabricated on the unsupported end of the cantilevered beam for engagement with a pair of spaced fixed contacts arranged on opposite lateral sides of the cantilevered beam.

When the switch of this invention is subjected to a magnetic field, the cantilever beam is magnetically attracted to the fixed stop to operate the contacts. The contact forces realized by magnetic operation of the cantilever beam are several orders of magnitude greater than those achieved by electrostatic operation, thereby providing lower contact resistance, higher current carrying capacity and longer contact life.

The invention and its advantages will become more apparent in the following description and claims when read in conjunction with the accompanying drawings.

DESCRIPTION OF THE PREFERRED EMBODIMENT

Figure 1:
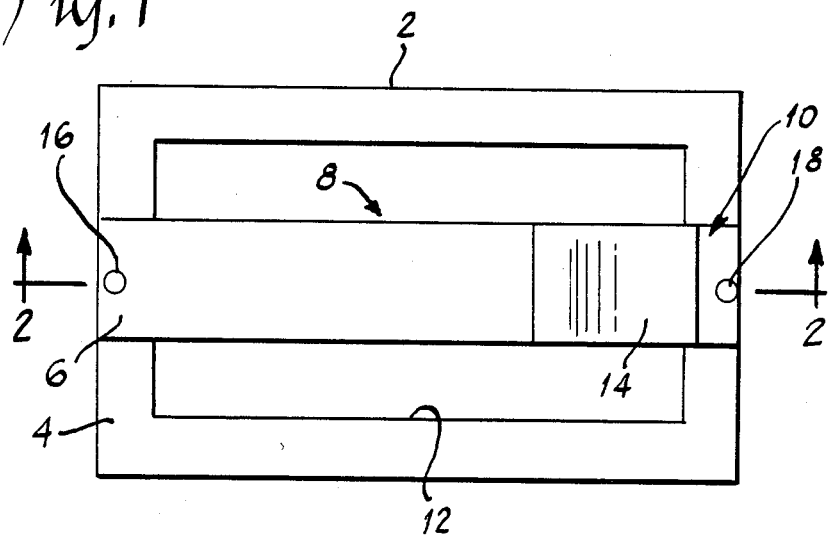
FIG. 1 is a top plan view of a thin-film magnetically operated micromechanical electric switching device constructed in accordance with this invention.
Figure 2:
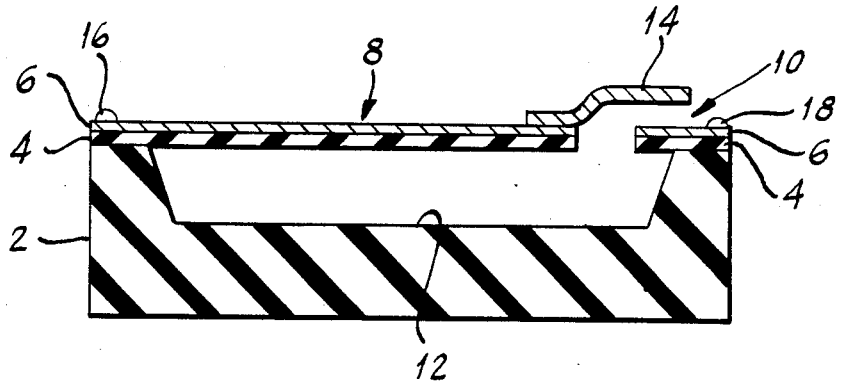
FIG. 2 is a cross-sectional view of the switching device of this invention taken along line 2—2 of FIG. 1.

With reference to FIGS. 1 and 2 of the drawings, a single-contact low-current micromechanical switching device is fabricated on a silicon substrate 2. A $SiO_2$ insulation layer 4 is grown on the upper surface of the substrate 2. A metallization layer 6 of magnetic material is next deposited on the upper surface of the insulating layer 4. Both the metallization layer 6 and the $SiO_2$ layer are then suitably etched to define a cantilevered beam 8 and a fixed stop 10 formed adjacent the unsupported end of the cantilevered beam 8 and to define the boundaries of a recess 12 in the substrate 2. While not specifically shown, photoresist masks are next applied to the upper surface of magnetic layer 6 according to the known techniques as described in the above referenced articles to define the shape of an armature 14 comprising a second layer of magnetic material which is deposited on the magnetic material 6 at the unsupported end of cantilever beam 8. The photoresist layers are subsequently stripped from the device wherein the armature layer 14 has a shallow S-shape as shown in FIG. 2 to overlie the fixed stop 10 in spaced relation thereto. An etchant is utilized to remove the material from below $SiO_2$ layer 4 in the substrate 2 to produce the recess 12. Unlike similar switches which operate electrostatically based on a capacitive effect such as those described in the aforementioned articles by Petersen, the depth of recess 12, i.e., the vertical distance from the underside of $SiO_2$ layer 4 to the bottom surface of the recess 12 is not critical for the magnetically operated device of this invention. Therefore, substrate 2 need not be formed to have a heavily doped boron layer which serves as a stop for the etchant to thereby critically define the depth of the recess 12. Instead, the recess 12 may be formed to a relatively wide toleranced depth by controlling the time length of exposure to the etchant. For the magnetically operated switch of this invention it is merely necessary to provide a recess of suitable depth to prevent interference with the cantilever beam when the latter is deflected.

In the switching device of FIGS. 1 and 2, the metallization layer 6 is provided with electrode attachment points 16, at the supported end of the cantilever beam 8, and 18 at the fixed stop 10. When the points 16 and 18 are connected through suitable electrical conductors into an electric circuit, and the switching device is subjected to a magnetic field, the beam 8 will deflect downward causing the armature layer 14 to close upon the fixed stop 10, thereby completing an electrical circuit through the switching device. Contact forces generated by the magnetic closure of the cantilever beam 8 upon fixed stop 10 are several orders of magnitude greater than those attainable in the aforementioned electrostatically operated switches, and as a result provide lower contact resistance, higher current capacity and longer contact life due to higher sealing forces between the movable and stationary contacts.

Figure 3:
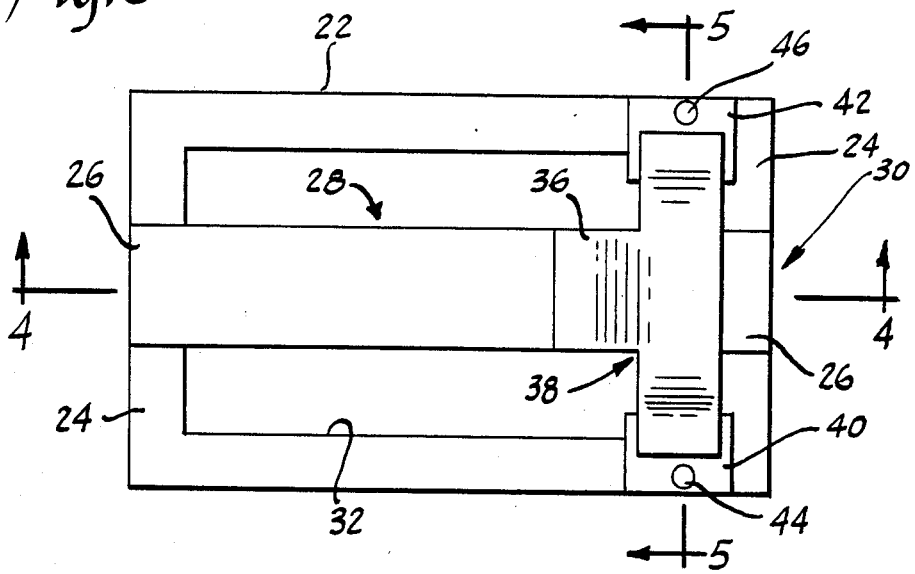
FIG. 3 is a top plan view of an alternate embodiment of a switching device constructed in accordance with this invention.
Figure 4:
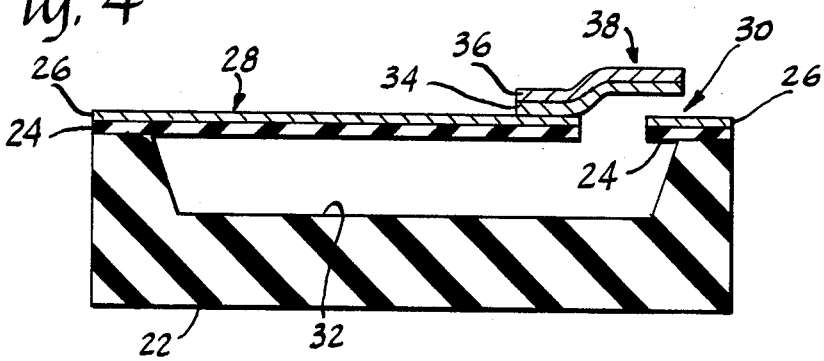
FIG. 4 is a cross-sectional view of the switching device of FIG. 3 taken along the line 4—4 in FIG. 3.
Figure 5:
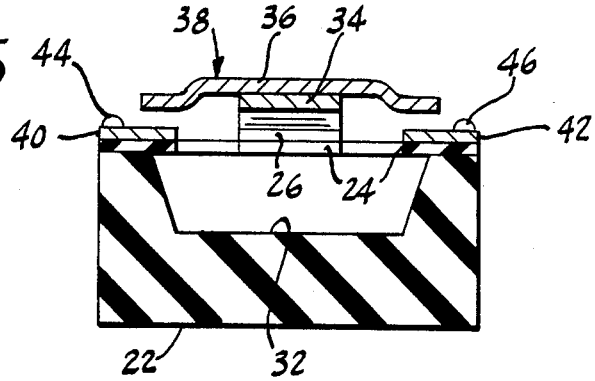
FIG. 5 is a cross-sectional view of the switching device of FIG. 3 taken along the line 5—5 of FIG. 3.

An alternative embodiment of the micromechanical switching device of this invention is shown in FIGS. 3–5. A silicon substrate 22 has an $SiO_2$ layer 24 grown on the upper surface thereof and a magnetic metallization layer 26 subsequently deposited to the upper surface of $SiO_2$ layer 24. As in the aforedescribed embodiment, the metallization layer 26 and the $SiO_2$ layer 24 are suitably etched to define a cantilever beam 28 and a fixed stop 30 adjacent the unsupported end of the cantilevered beam. Subsequent photoresist, plating, and etching steps define a recess 32 in substrate 22 and the cantilever beam 28, an armature 34 comprising a second magnetic layer deposited on layer 26 at the unsupported end of cantilever beam 28 to extend over fixed stop 30 in spaced relation thereto, a layer 36 of good electrical conductive material such as gold or the like deposited on the second magnetic layer 34 for defining a bridging contact member oriented at right angles to the major dimension of the cantilever beam 28, and a pair of contact surfaces 40 and 42 deposited on layer 24 at opposite lateral sides of the cantilever beam 28 along the lateral edges of substrate 22 in alignment with respective opposite ends of bridging contact member 38. Electrode connection points 44 and 46 are formed on the contact elements 40 and 42, respectively, for attachment of the switching device to an electric circuit.

When the switching device of FIGS. 3–5 is subjected to a magnetic field, the magnetic layers 26 and 34 cooperate to deflect the cantilever beam 28 downwardly until armature layer 34 engages fixed stop 30. The distance between the underside of armature layer 34 and the upper surface of layer 26 at fixed stop 30 is slightly greater than the distance between the underside of contact portions at the ends of bridging contact member 38 and the upper surfaces of contact elements 40 and 42, respectively. Thus, when operated, contact 38 will close upon stationary contacts 40 and 42 before armature layer 34 closes upon the fixed stop 30. Continued movement of cantilever beam 28 to cause armature layer 34 to seat upon fixed stop 30 will cause deflection in the bridging contact member 38 so as to provide a wiping action for the bridging contact 38 upon the respective stationary contacts 40 and 42, thereby enhancing the quality of the electrical contact therebetween, providing high contact pressure, higher current capacity and low contact resistance, and thereby prolonging contact life.

The foregoing describes an improved thin-film micromechanical switching device formed by semiconductor fabrication techniques which provides contact forces which are orders of magnitude greater than those achievable in similar switches which are electrostatically operated, thereby permitting application of the switch of this invention to pilot duty control applications. Where necessary, it is contemplated that the switching device of this invention may be hermetically sealed in a glass envelope or the like. This and other modifications of the switch of this invention are deemed possible without departing from the scope of the appended claims.

I claim:

1. A thin-film magnetically operated micromechanical electric switching device, comprising:

a substrate having a recess in a surface thereof;

an insulating layer grown on said surface and including a cantilever beam extending over said recess;

magnetic means deposited on said insulating layer along said cantilever beam and on a fixed stop portion aligned with and proximate an unsupported end of said cantilever beam, said magnetic means on said cantilever beam projecting beyond said unsupported end thereof and overlying said fixed stop portion in spaced relation thereto; and contact means operable between open and closed contact positions in response to movement of said beam;

wherein said cantilever beam is movable when subjected to a magnetic field to effect closing of said projecting magnetic means upon said fixed stop portion magnetic means for operating said contact means.

2. The invention defined in claim 1 wherein said magnetic means are current carrying means for serving as said contact means.

3. The invention defined in claim 1 wherein said magnetic means comprises a first magnetic layer deposited on said insulating layer along said cantilever beam and on said fixed stop portion, and said projecting magnetic means comprises a second magnetic layer deposited on said first layer at said unsupported end of said cantilever beam.

4. The invention defined in claim 1 wherein said contact means comprises first and second contact surfaces bonded to said insulating layer at laterally spaced opposite sides of said cantilever beam in proximity to said unsupported end thereof and a bridging contact carried by said cantilever beam for movement into and out of bridging engagement with said first and second contact surfaces.

5. A thin-film magnetically operated micromechanical electric switching device, comprising:

a substrate having a recess in a surface thereof;

an insulating layer bonded to said surface and including a cantilever beam extending over said recess;

a first magnetic metallization layer deposited on said insulating layer along said cantilever beam and in an area proximate an unsupported end of said cantilever beam and aligned with said beam;

an armature comprising a second magnetic metallization layer bonded on said first magnetic metallization layer at said unsupported end of said cantilever beam, said armature overlying and being spaced from said area proximate said unsupported end of said beam; and contact means operable between open and closed contact positions in response to movement of said beam;

wherein said cantilever beam is movable when subjected to a magnetic field to effect closing of said armature upon said area proximate said unsupported end of said beam for operating said contact means.

6. The invention defined in claim 5 wherein said first and second metallization layers comprise said contact means.

7. The invention defined in claim 5 wherein said contact means comprise first and second contact surfaces deposited on said insulating layer and arranged at laterally spaced opposite sides of said cantilever beam, and a bridging contact carried by said cantilever beam for movement into and out of bridging engagement with said first and second contact surfaces.

8. The invention defined in claim 7 wherein said bridging contact is deposited on said second magnetic metallization layer.

9. The invention defined in claim 8 wherein said bridging contact comprises a resilient beam arranged transversely to a lengthwise dimension of said beam to overlie said first and second contact surfaces in spaced relation thereto, and wherein said bridging contact closes upon said first and second contact surfaces before said armature closes upon said area proximate said unsupported end of said beam.

* * * * *